United States Patent [19]

Harper, Jr.

[11] Patent Number: 4,915,164

[45] Date of Patent: Apr. 10, 1990

[54] HEAT EXCHANGER

[76] Inventor: William H. Harper, Jr., 1454 Amon Dr., Richland, Wash. 99352

[21] Appl. No.: 211,862

[22] Filed: Jun. 27, 1988

[51] Int. Cl.[4] ..... F28D 7/10

[52] U.S. Cl. ..... 165/164; 165/143; 165/145; 165/154; 165/903

[58] Field of Search ..... 165/14 B, 145, 154, 165/155, 903, 164

[56] References Cited

U.S. PATENT DOCUMENTS 1,833,876 11/1931 McGrath ..... 165/143

2,807,446 9/1957 Friedman et al. ..... 165/143

FOREIGN PATENT DOCUMENTS 195782 11/1983 Japan ..... 165/145

*Primary Examiner*—Albert W. Davis, Jr.

*Attorney, Agent, or Firm*—Cahill, Sutton & Thomas

[57] ABSTRACT

A heat exchanger includes a plurality of in-line segments for alternately enveloping one fluid flow with another fluid flow with the fluid flow exchange occurring at the junction of adjacent segments through a geometric surface mathematically termed a complete embedded minimal surface. An encircling cylindrical shell defined in diameter by the perimeter of the junction surface forms the outer boundary of the in-line segments. The fluid flows may be in the same or opposed directions, depending upon the nature of the results sought by the heat exchanger in a specific environment.

18 Claims, 1 Drawing Sheet

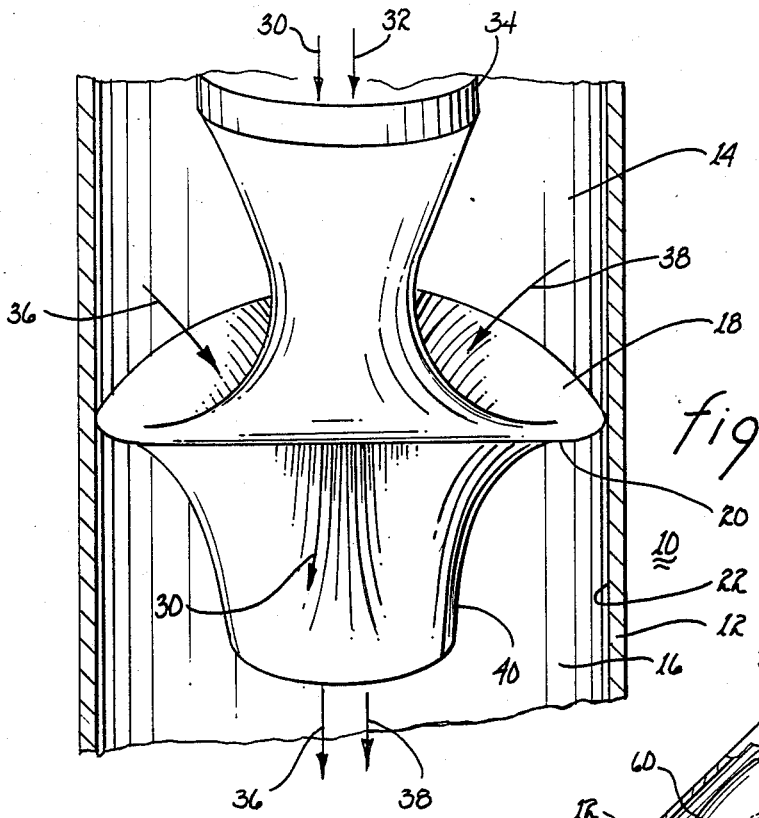
fig. 1
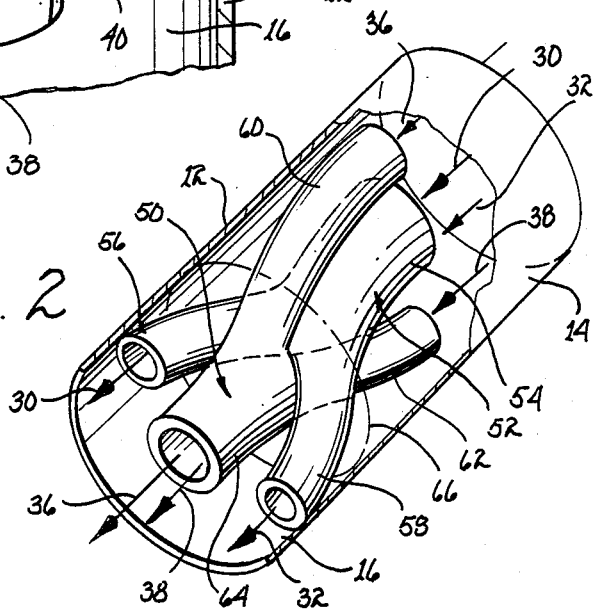
fig. 2
fig. 3
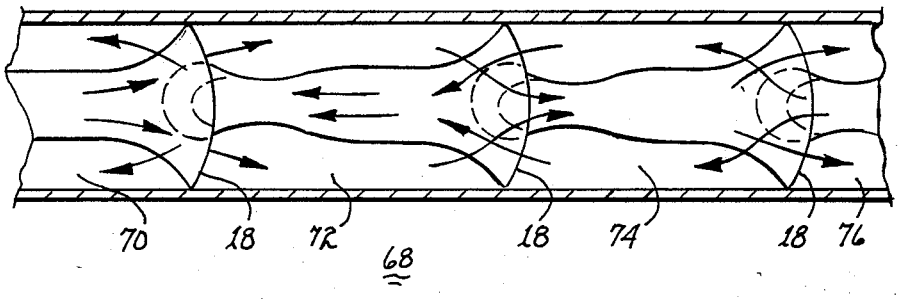

HEAT EXCHANGER

BACKGROUND OF THE INVENTION

1. Field of the Invention

The present invention relates to heat exchangers and, more particularly, to a surface for entwining one fluid flow about another fluid flow.

2. Description of the Prior Art

Heat exchangers for exchanging heat between two adjacent flows of fluid are well known. Embodiments of these heat exchanger include the use of a pair of concentric pipes wherein one fluid flows in the central pipe while a second fluid flows in the space defined between the central and an outer pipe. The direction of flow of the fluids may be the same or counter to one another. Various structures have been employed to direct the segregated fluids into and out of such heat exchangers. Another well known heat exchanger is a device having a first pipe for conveying a first fluid into, through and out of a container having a second fluid therein. In a variant heat exchanger, fins may be attached to a conduit for a first fluid to maximize the surface area of contact with a second fluid to promote an exchange of heat therebetween. In yet a further type of heat exchanger, a plurality of pipes convey in parallel a first fluid through a container for a second fluid; a first plenum is disposed in fluid communication with one end of the plurality of pipes to direct fluid thereinto and a second plenum is disposed at the second end of the plurality of pipes to collect fluid therefrom.

Generally, the junction itself at which the flows of two fluids of a heat exchanger is not capable of performing an effective or efficient exchange of heat. That is, these junctions are primarily intended for purposes of channeling the fluid flows and are not designed deliberately to perform a heat exchanging function.

Heat exchangers having one fluid flow enveloped by a second fluid flow maintain such relationship of the fluids throughout the flow within the heat exchanger. Few, if any, heat exchangers of this type are capable of alternately enveloping one fluid with the other fluid during the flow through the heat exchanger.

SUMMARY OF THE INVENTION

A heat exchanger includes a plurality of segments for alternately enveloping the flow of one fluid with the flow of a second fluid while precluding any mixing therebetween. The junction at which the fluid flows alternate is a geometric configuration known as a complete, embedded minimal surface. In particular, this surface is known as a Hoffman Meeks Costa Surface. This surface, at each junction between segments and encircled by a cylinder, converts a single stream of flow to two streams for one of the fluids and converts a two-stream flow of the other fluid to a single stream of flow. Each single stream flow is enveloped by the two-stream flow of the other fluid. As the two fluids are continuously adjacent one another, except for the intervening segregating surface, exchange of heat between the two fluids occurs during flow within each section and during flow through the junctions between adjacent sections. The nature of the geometric surface is inherently such that the cross sectional defined by the single stream flow is the same as the cross sectional area defined by the two-stream flow whereby flow losses are minimized. The curvature of the junction for directing the flow change is inherently smooth and streamlined to minimize losses due to flow disruption.

It is, therefore, a primary object of this invention to provide an efficient two-fluid flow heat exchanger.

Another object of the present invention is to provide a junction between sections of a heat exchanger to alternately envelope one fluid flow with a second fluid flow.

Still another object of the present invention is to provide a multi-sectioned heat exchanger for alternately enveloping one fluid with another fluid.

Yet another object of the present invention is to provide a heat exchanger having constant cross sectional areas for the flows of each of two fluids alternately enveloping one another.

A further object of the present invention is to provide a low loss junction for transitioning a reversal in flow relationship between an enveloped fluid and an enveloping fluid.

A still further object of the present invention is to provide a method for exchanging heat between two fluids by alternately enveloping one fluid with another fluid.

A still further object of the present invention is to provide a method for transposing an enveloped fluid into an enveloping fluid at each junction between serial sections of a heat exchanger.

These and other objects of the present invention will become apparent to those skilled in the art as the description proceeds.

DESCRIPTION OF THE DRAWINGS

The present invention may be described with greater specificity and clarity with reference to the following drawings in which:

FIG. 1 is a partial cross sectional view illustrating the junction between two sections of a heat exchanger;

FIG. 2 illustrates a functional representation of the present invention; and FIG. 3 illustrates the flow paths of two fluids in each serial section and at each junction between sections of a multisectioned heat exchanger.

DESCRIPTION OF THE PREFERRED EMBODIMENT

Referring to FIG. 1, there is illustrated a heat exchanger 10 having an exterior cylindrical member 12. The cylindrical member may extend to include a plurality of sections. A part of two such sections 14, 16, are illustrated. Sections 14 and 16 are segregated by surface 18 having a circular perimeter 20 coincident with and secured to inner cylindrical surface 22 of cylindrical member 12.

As suggested by arrows 30, 32 the flow of one fluid within section 14 is within a cylindrical surface 34 centrally disposed within cylindrical member 12. As suggested by arrows 36, 38, the flow of a second fluid is within an annular space defined by cylindrical member 12 and cylindrical surface 34. In section 16, the flow of fluid depicted by arrows 36, 38 has been transformed by surface 18 to a flow within a cylindrical surface 40 centrally disposed within cylindrical member 12. The fluid flow depicted by arrows 30, 32 has been transformed by surface 18 to an initial two-stream flow of which one stream, being depicted by arrow 30, is illustrated in FIG. 1. The second stream, depicted by arrow 32, is on the opposite side of cylindrical surface 40.

In summary, the enveloped fluid (depicted by arrows 30, 32) in section 14 has become the enveloping fluid in section 16. Conversely, the enveloping fluid (depicted by arrows 36, 38) has become the enveloped fluid in section 16.

To better understand and visualize the fluid flow exchange which occurs as a result of the configuration of surface 18 disposed within cylindrical member 12, reference is made to FIG. 2. It is to be understood that this figure is technically incorrect in depicting the flow represented in FIG. 1 but it permits visualization of the flow exchange and maintenance of segregation between the two fluid flows. For the sake of simplicity, the numerals used in FIG. 1 will be incorporated in FIG. 2 where the function of the referenced element is the same.

The functional structure provided by surface 18 is functionally equivalent to the two intertwined opposed Y-shaped conduits 50, 52 illustrated in FIG. 2. That is, the fluid flow represented by arrows 30, 32 central to section 14 flowing through base 54 of "Y" 52 is divided into arms 56, 58 to contain fluid flows depicted by arrows 30, 32, respectively. Similarly, the fluid flows depicted by arrows 36, 38 on opposed sides of base 54 in arms 60, 62 of "Y" 50 are combined in base 64.

The fallacy with the structure depicted in FIG. 2 may be summarized as follows. The fluid flows represented by arrows 36 and 38 extend completely about base 54 to the inner cylindrical surface of cylindrical member 12. Similarly the fluid flow from arms 56, 58 and depicted by arrows 30, 32 extends completely about base 64 and to the inner cylindrical surface of cylindrical member 12. Surface 18 (see FIG. 1) extends to the inner cylindrical surface of cylindrical member 12 to prevent flow between sections 14 and 16 unless such flow is directed in the manner depicted by arrows 30, 32 and 36, 38; this aspect of surface 18 (FIG. 1) is depicted by dashed line 66 in FIG. 2.

Referring to FIG. 3, there are shown a plurality of serially connected sections 70, 72, 74 and 76 of a heat exchanger 68 or the like. One of a plurality of surfaces 18 (see FIG. 1) segregates section 70 from section 72, section 72 from section 74 and section 74 from 76. Additionally, each of surfaces 18 converts the flow from a central cylindrical area of a first section to an annular area of a second section simultaneous with the conversion of the annular area of flow of the first section to a cylindrical central area of flow of the second section.

For the sake of simplicity and to more clearly illustrate the alternating flow paths of two segregated fluids within heat exchanger 68, one fluid flow is depicted by arrows as being from left to right while the second flow is depicted by arrows as being from right to left. As is evident by inspection of the structure illustrated in FIG. 3, each fluid flowing is thermally subject to the other fluid within each section and at the junction between sections. Furthermore, the efficiency of heat exchange between the two fluids is promoted by alternately having one fluid envelope the other. It is to be understood that the flows may be in the same direction or in opposed directions, as illustrated.

Surface 18 constitutes a geometric surface known as a Hoffman Meeks Costa Surface jointly developed by mathematicians, David A. Hoffman, William H. Meeks and Celso J. Costa. The proper technical term for surface 18 is a geometric surface known as a complete embedded minimal surface wherein the term minimal refers to the area which as small as it can possibly be and the term embedded refers to the fact that the surface does not intersect itself.

While the principles of the invention have now been made clear in the illustrated embodiments, there will be immediately obvious to those skilled in the art, many modifications of structures, arrangements, proportions, elements, materials and components used in the practice of the invention and otherwise, which are particularly adapted for specific environments and operational requirements without departing from those principles. The appended claims are therefore intended to cover and embrace any such modifications within the limits only of the true spirit and scope of the invention.

I claim:

1. A heat exchanger for transferring heat between two fluids segregated from one another, said heat exchanger comprising in combination:

(a) section for maintaining the flow of a first fluid enveloped with the flow of a second fluid; and (b) means for enveloping the flow of the first fluid with the flow of the second fluid said enveloping means including a complete embedded minimal surface.

2. A heat exchanger as claimed in claim 1 wherein said section is disposed on one side of said enveloping means and including a second one of said section, said second section being disposed on the other side of said enveloping means.

3. A heat exchanger as claimed in claim 2 including a further one of said enveloping means disposed at the end of said second section for enveloping the flow of the second fluid with the flow of the first fluid.

4. A heat exchanger as claimed in claim 1 wherein said surface is a Hoffman Meeks Costa Surface.

5. A heat exchanger as claimed in claim 4 wherein said surface is disposed at each of opposed ends of said section.

6. A heat exchanger as claimed in claim 5 including a further one of said section secured to said section by one of said surfaces.

7. A heat exchanger as claimed in claim 6 including a yet further one of said section secured to said section by another of said surfaces.

8. A method for transferring heat from a first fluid to a second fluid, said method comprising the steps of:

(a) introducing a flow of a first fluid and a flow of a second fluid;

(b) enveloping the flow of the first fluid with the flow of the second fluid with a complete embedded minimal surface;

(c) maintaining the flow of the first fluid with the flow of the second fluid for a predetermined period; and (d) discharging the flows of the first and second fluids.

9. A method for transferring heat as claimed in claim 8 wherein said step of enveloping the includes the step of alternating the enveloped and enveloping flows after exercise of said maintaining step.

10. A method for transferring heat as claimed in claim 9 wherein said steps of alternating and maintaining are exercised alternately.

11. A heat exchanger for transferring heat between two fluids segregated from one another, said heat exchanger comprising in combination:

(a) a plurality of sections, each said section including a first passageway, a member for enveloping said passageway and a second passageway defined by the space between said first passageway and said member; and (b) a completed embedded minimal surface disposed at the junction of adjacent sections for altering the flow in said first passageway of one section to said second passageway of an adjacent section and for simultaneously altering the flow in said first passageway of said adjacent section to said second passageway of said one section.

12. A heat exchanger as claimed in claim 11 wherein said member is a cylinder.

13. A heat exchanger as claimed in claim 12 wherein said first passageway defines a cylindrical surface.

14. A heat exchanger as claimed in claim 13 wherein said second passageway is annular in cross section.

15. A heat exchanger as claimed in claim 14 wherein said surface depends radially from the inner surface of said cylinder.

16. A heat exchanger as claimed in claim 15 wherein said surface is a Hoffman Meeks Costa Surface.

17. A heat exchanger as claimed in claim 11 wherein said surface extends across said member.

18. A heat exchanger as claimed in claim 17 wherein said surface is a Hoffman Meeks Costa Surface.

* * * * *